US008904820B2

(12) United States Patent
Chen

(10) Patent No.: US 8,904,820 B2
(45) Date of Patent: Dec. 9, 2014

(54) WEARABLE DINING UTENSIL

(71) Applicant: Yu-Chiuan Chen, Taipei (TW)

(72) Inventor: Yu-Chiuan Chen, Taipei (TW)

( * ) Notice: Subject to any disclaimer, the term of this patent is extended or adjusted under 35 U.S.C. 154(b) by 121 days.

(21) Appl. No.: 13/778,118

(22) Filed: Feb. 27, 2013

(65) Prior Publication Data

US 2014/0237825 A1 Aug. 28, 2014

(51) Int. Cl.
*A44C 25/00* (2006.01)
*A47G 21/02* (2006.01)

(52) U.S. Cl.
CPC ..... *A47G 21/02* (2013.01)
USPC ..... 63/1.12; 63/1.16; 63/1.17; 63/3; 63/41; 294/5.5; 294/218

(58) Field of Classification Search
USPC ..... 63/41, 1.12, 1.16, 1.17, 3; 294/5.5, 218
See application file for complete search history.

(56) References Cited

U.S. PATENT DOCUMENTS 452,830 A * 5/1891 Bowie et al. ..... 224/220
D150,655 S * 8/1948 Reinecke ..... D11/2
2,453,190 A * 11/1948 Boscowitz ..... 63/1.12
5,131,151 A * 7/1992 Agase et al. ..... 30/327
D335,637 S * 5/1993 Azrielant ..... D11/4
5,305,934 A * 4/1994 Grey ..... 224/617
5,810,411 A * 9/1998 Major ..... 294/99.2
7,093,868 B1 * 8/2006 Shen ..... 294/218
7,258,375 B1 * 8/2007 Shen ..... 294/218
7,571,943 B1 * 8/2009 Lee ..... 294/218
7,896,413 B2 * 3/2011 Shen Ku ..... 294/218
8,176,751 B2 5/2012 Chen
2008/0135711 A1 * 6/2008 Bunting ..... 248/328
2009/0229130 A1 * 9/2009 Swierski et al. ..... 30/123

* cited by examiner

*Primary Examiner* — Jack W Lavinder

(57) ABSTRACT

A wearable dining utensil comprises a rigid function portion for engaging food, a holder for holding the dining utensil, a shapeable connector having a third linking part and a fourth linking part for fixing a bendable portion, and a fifth linking part having an outlet for linking with the fourth linking part. One end of the rigid function portion also serves as a male linker and the opposite end has a first linking part. One end of the holder serves as a female linker for linking with the male linker, and the opposite end has a second linking part. When the female linker is linked with the male linker, the dining utensil forms a loop, and when the outlet is linked with the fourth linking part, the dining utensil forms a regular utensil. According to various connecting profiles, the dining utensils can form a bracelet, necklace or an ornament.

18 Claims, 8 Drawing Sheets

WEARABLE DINING UTENSIL

BACKGROUND OF THE INVENTION

1. Field of the Invention

The present invention relates to a portable dining utensil, and more particularly to a loopable and wearable dining utensil, for example a chopstick, a fork or a spoon. According to various connecting profiles, the multiple dining utensils can form a bracelet, necklace, belt or an ornament of handbag or hand-held mobile device.

2. Description of the Prior Art

As well known to those skilled in the art, Yu-Chivan Chen teaches a loopable and wearable dining utensil in U.S. Pat. No. 8,176,751, a previous creation of the present invention, granted on May 15, 2012. FIGS. 1A through 1B are views illustrating the loopable and wearable dining utensil of Chen. As shown in FIG. 1A, a chopstick 300 includes a rigid function portion 301, a holder 303 and a flexible connector 118. The rigid function portion 301 has a chopstick terminating at one end in a rounded tip which is intended to engage portions of food and the rounded tip also serves as a male linker 302. The opposite end of the rigid function portion 301 has a first linking part 116 which is of a rectangle cross-section. The holder 303 is intended to hold the chopstick 300. One end of the holder 303 serves as a female linker 306 used for linking with the male linker 302, and the opposite end has a second linking part 112 used for linking with the first linking part 116. The flexible connector 118 intended to connect the rigid function portion 301 and the holder 303 has a flexible member 122 and a stopper 124. The chopstick 300 forms a loop when the male linker 302 is engaged with the female linker 306 of the holder 303, as shown in FIG. 1B. The chopstick 300 forms a normal used chopstick which has the flexible connector 118 received in the inner of the chopstick when the first linking part 116 is engaged with the second linking part 112 of the holder 303.

From the above description, the features of U.S. Pat. No. 8,176,751 enable dining utensils to be wearable by using simple structure and easy assembly to form a bracelet, necklace, belt or an ornament of handbag or hand-held mobile device. Second, since a carrying case is excluded, a carrying volume is reduced and burden of user is also relieved. Furthermore, dining utensils as personal ornaments triggers user to bear when eating outside on weekdays, which is sustainable to our environment.

The loopable and wearable chopstick 300 is easily carried and wearable as ornaments. However, the wearable chopstick is very loose. This is that the shape and size of the wearable chopstick could not be adjusted and fixed due to the configuration of the flexible connector 118. And, the beauty of ornaments can not be shown. Moreover, as the flexible connector is a wire or a chain, the second linking part 112 and first linking part 116 easily get dirt accumulation when the chopstick 300 forms a loop-shaped ornament. In addition, the flexible connector 118 is not easily to receive in the inner of the chopstick 300 when forming a normal used chopstick.

SUMMARY OF THE INVENTION

An objective of the present invention is to solve the above-mentioned problems and to provide a wearable dining utensil, for example a chopstick, a fork or a spoon, characterized by a shapeable connector and easy assembly to form a bracelet, necklace, belt or an ornament of handbag or hand-held mobile device. The shapeable connector can be adjusted and fixed when forming a loop-shaped ornament.

The present invention achieves the above-indicated objective by providing a wearable dining utensil. The wearable dining utensil comprises a rigid function portion for engaging food, a holder for holding the dining utensil, and a shapeable connector for connecting the rigid function portion and the holder. The rigid function portion has a tip terminating at one end for engaging food, wherein the tip also serves as a male linker and the opposite end of the rigid function portion has a first linking part. The holder has one end serving as a female linker and the opposite end having a second linking part, wherein the female linker is used for linking with the male linker. The second linking part extends a hollow to a middle part of the holder. The shapeable connector has a third linking part and a fourth linking part extending from the third linking part, for connecting the rigid function portion and the holder, wherein the third linking part is used for linking with the first linking part and the fourth linking part is used for fixing a bendable portion, wherein the bendable portion can be bent into a desired shape and can be recovered with a reverse force. And, a fifth linking part is used for linking with the second linking part. One central part of the fifth linking part has an outlet whose shape is adopted to fit the bendable portion. The outlet is used for linking with the fourth linking part and can get the bendable portion moving through the middle part of the holder when the fifth linking part, the shapeable connector and the second linking part are linked. The dining utensil forms a loop with a desired size and shape when the male linker is engaged with the female linker as well as the dining utensil forms a normal used dining utensil which has the shapeable connector received in the inner of the dining utensil when the fourth linking part is engaged with the outlet.

The following detailed description, given by way of examples and not intended to limit the invention solely to the embodiments described herein, will best be understood in conjunction with the accompanying drawings.

DETAILED DESCRIPTION OF THE PREFERRED EMBODIMENTS

The present invention discloses a wearable dining utensil, for example a chopstick, a fork or a spoon. The wearable dining utensil is easy to carry and can be used as ornaments. The shape and size of the wearable dining utensil with a shapeable connector can be adjusted and fixed when forming a loop-shaped ornament. Preferably, the dining utensil is fabricated of antibacterial plastic, ceramics, stainless steel or other metals, or surfaces of the dining utensil are coated with antibacterial thin films through electroplating, chemical vapor deposition (CVD) or physical vapor deposition (PVD). Thus, the cleanness and sanitation of the wearable dining utensil can be maintained.

Embodiment 1

FIGS. 2-7 show aspects of a wearable fork in the embodiment 1 of the present invention.

Figure 1A:
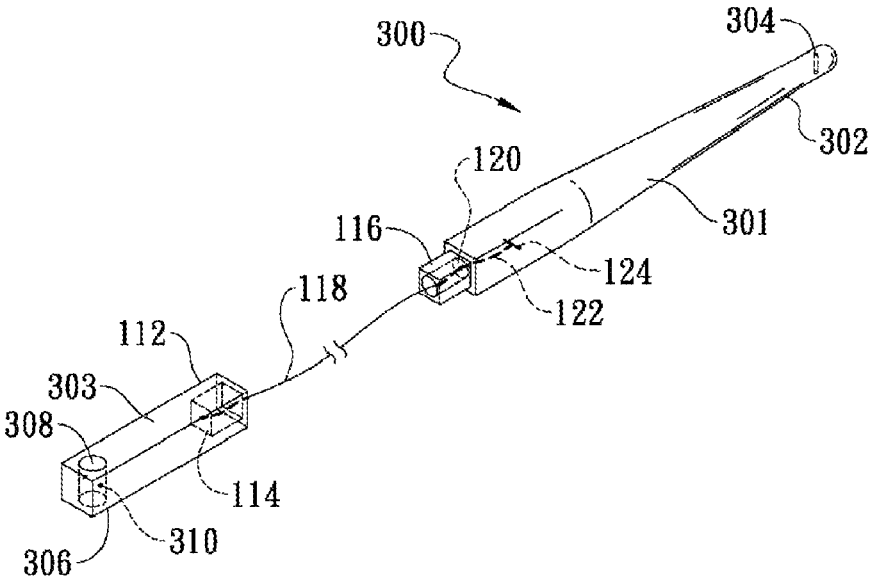
FIG. 1A (Prior Art)
FIGS. 1A and 1B are perspective views of a conventional loopable and wearable chopstick.
Figure 1B:
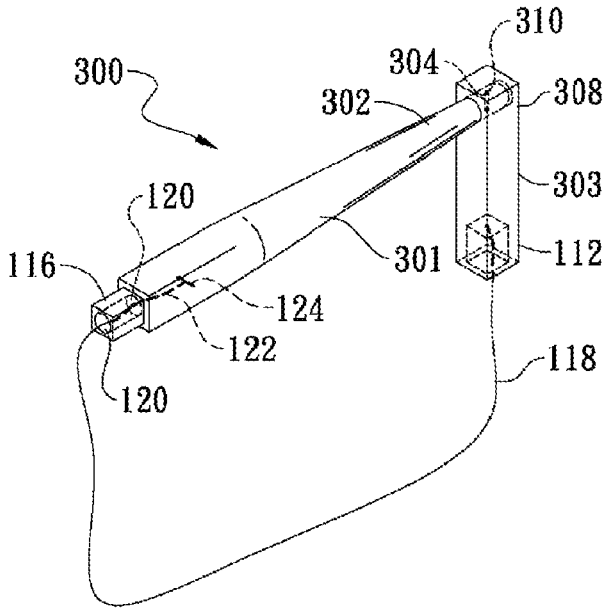
FIG. 1B (Prior Art)
Figure 2:
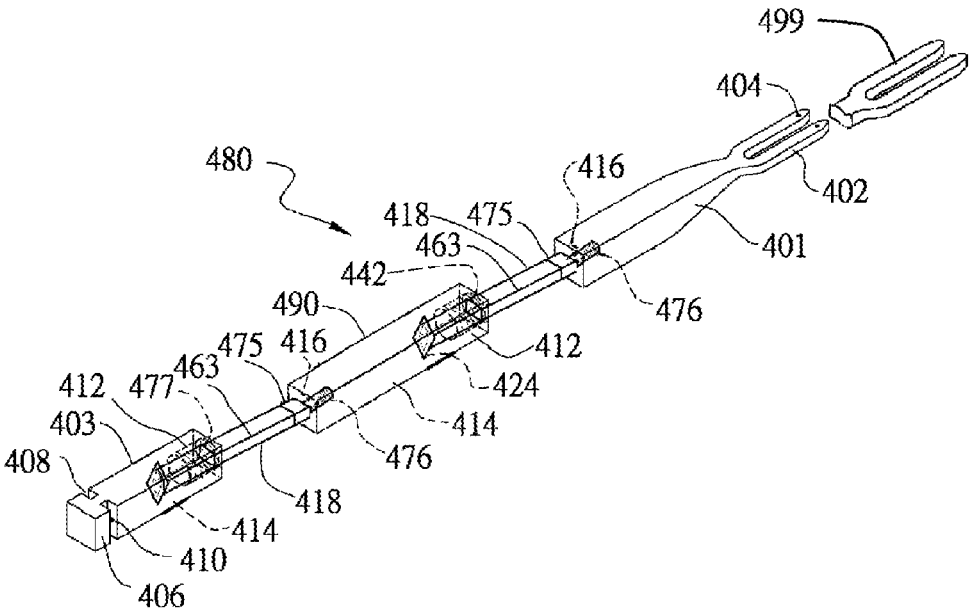
FIG. 2 is an exploded perspective view of a wearable fork of the present invention.
Figure 3:
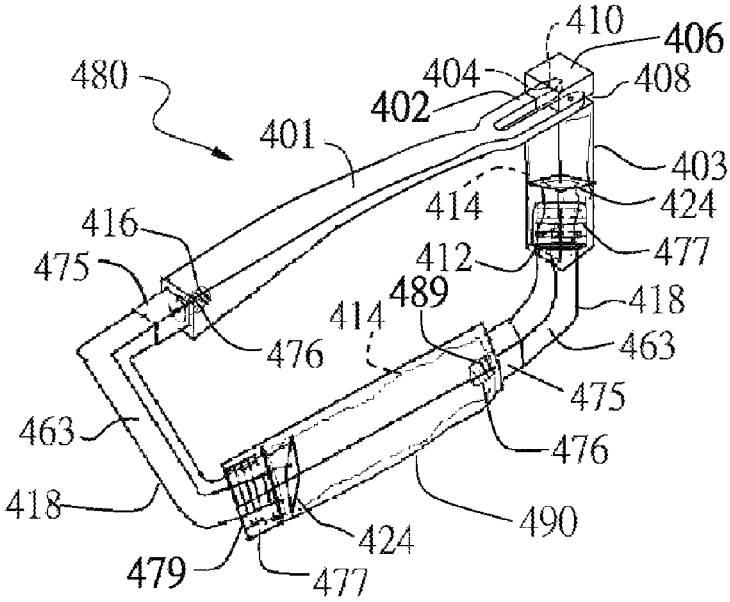
FIG. 3 is a perspective view of the fork of FIG. 2 forming a loop.

FIG. 2 is an exploded perspective view of a wearable fork. As shown in FIG. 3, a fork 480 includes a rigid function portion 401, a holder 403, a rigid central portion 490 and two shapeable connectors 418. The rigid function portion 401 in the embodiment 1 has a fork terminating at one end in a pair of splitting tips, which is intended to stick into portions of food, and the splitting tips also serve as a male linker 402. The opposite end of the rigid function portion 401 has a first linking part 416 which is of a round cross-section. The holder 403 is intended to hold the fork 480. One end of the holder 403 serves as a female linker 406 used for linking with the male linker 402, and the opposite end has a second linking part 412 extending a hollow to a middle part 414 of the holder 403. The shapeable connectors 418 intended to connect the rigid function portion 401, the rigid central portion 490 and the holder 403 have a third linking part 476 used for linking with the first linking part 416. A fourth linking part 475 extending from the third linking part 476 is used for fixing a bendable portion 463. The bendable portion 463 can be bent into a desired shape and can be recovered with a reverse force by hands. A fifth linking part 477 is used for linking with the second linking part 412. A central part of the fifth linking part 477 has an outlet 442 whose shape is adopted to fit the bendable portion 463. The outlet 442 is used for linking with the fourth linking part 475 and can get the bendable portion 463 moving through the middle part 414 of the holder 403 when the fifth linking part 477, the shapeable connector 418 and the second linking part 412 are linked. A stopper 424 is formed at one end of the bendable portion 463 to prevent the bendable portion 463 from separating off the fifth linking part 477. A transparent silicone sheath 499 with a thickness of 0.02 to 0.5 mm forming a protective cover upon the rigid function portion 401 is added. The protective cover 499 is a replaceable consumable. Silicone, sustainable to high heat-resistant about 190° C., can be used in the dishwasher and boiled disinfections to ensure health.

Two cavities 408 for engaging with the male linker 402 are formed in the female linker 406 of the holder 403. Dents 404 for locking with knots 410 which are formed on each middle site of sidewalls of the cavities 408 are formed on the tips of the male linker 402. A shape of the cavities 408 is adopted to fit the male linker 402 resulting in matched coupling formed by the cavities 408 and the male linker 402. Cavities 408 can be formed in the bottom side of female linker 406 and can be four sides closed cavities. One rigid central portion 490 can be added between the rigid function portion 401 and the holder 403 of the fork 480 as shown in FIG. 2. Two shapeable connectors 418 are used to link the rigid central portion 490 with the rigid function portion 401 and the holder 403. The rigid central portion 490 has a sixth linking part 479 used for linking with the fifth linking part 477, and a seventh linking part 489 used for linking with third linking part 476. The sixth linking part 479 formed at one end of the rigid central portion 490 has the same structure and function to the second linking part 412. The seventh linking part 489 has the same structure and function to the first linking part 416. It is understood that the rigid central portion 490 is used to increase a length of the fork 480.

Figure 4:
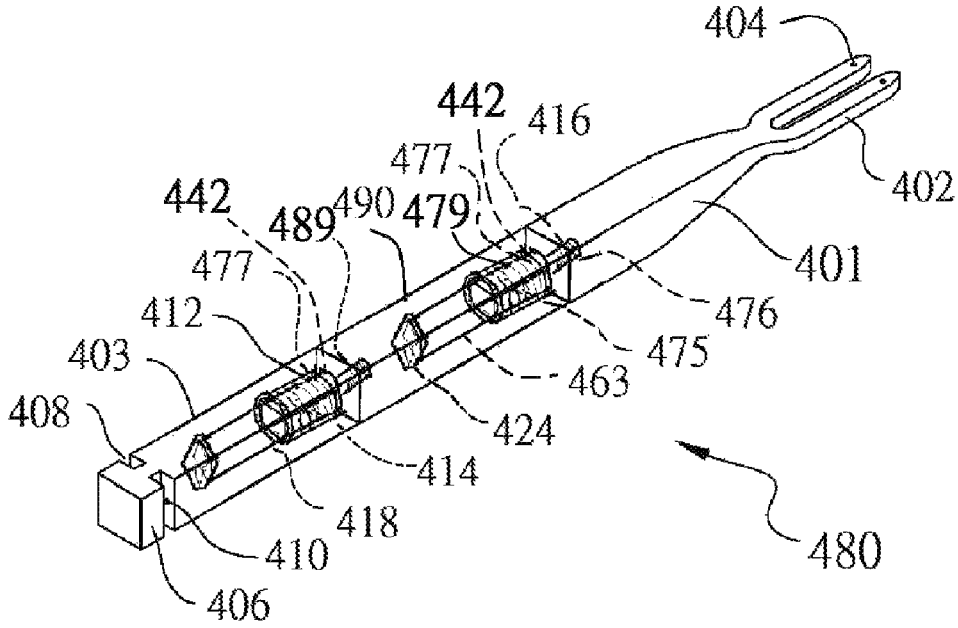
FIG. 4 is a perspective view of the fork of FIG. 2 forming a normal used fork.
Figure 5:
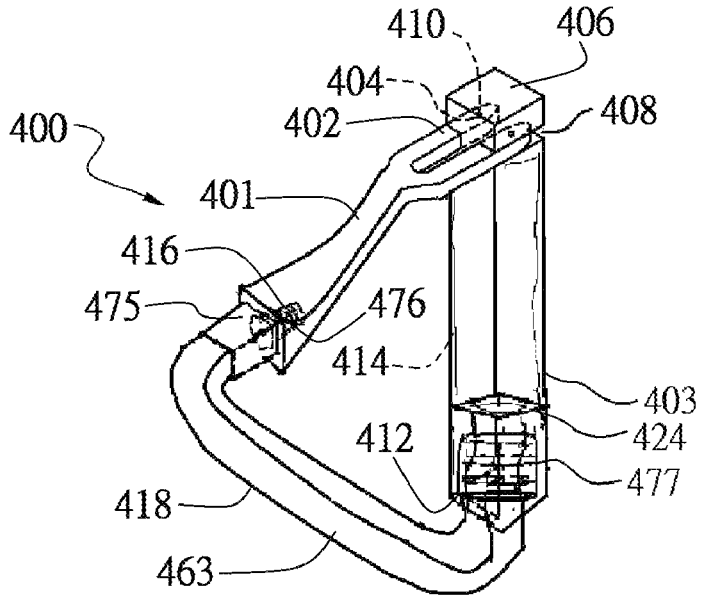
FIG. 5 is a perspective view of the fork of FIG. 2 forming a loop and without a rigid central portion.

The fork 480 forms a loop with a desired size and shape when the male linker 402 is engaged with the female linker 406 of the holder 403, as shown in FIG. 3. Additionally, the shape and size of the loop-shaped fork 480 can be adjusted and fixed through the bendable portions 463. The fork 480 forms a normal used fork which has the two shapeable connectors 418 received in the inner of the fork 480 when each the fourth linking part 475 is engaged with each the outlet 442, as shown in FIG. 4. Furthermore, the rigid central portion 490 is an optional element. A loop-shaped fork 400 without a rigid central portion 490 is an essential implementation of the claimed invention, as shown in FIG. 5.

Figure 6:
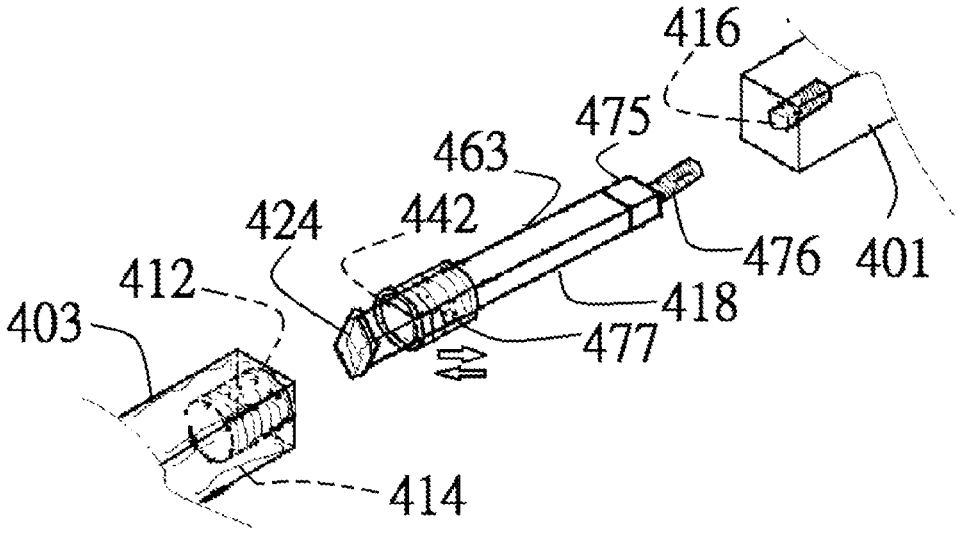
FIG. 6 is a perspective view of the first linking part, second linking part and the shapeable connector.

FIG. 6 is a perspective view of the first linking part, second linking part and the shapeable connector. As shown in FIG. 6, the first linking part 416 has a female thread, and the third linking part 476 has a male thread; a connection manner of these two components is a connection of thread. An aspect of a connection manner of the fifth linking part 477 and the second linking part 412 is also a connection of thread. A cross-section shape of the fourth linking part 475 and of the outlet 442 is a circle, ellipse, square or rectangle, and an external diameter of the fourth linking part 475 is about equal to an internal diameter of the outlet 442 causing a tight connection. The tight connection can prevent dirt accumulation when the fork 480 forms a normal used fork. A washer can be coupled in the inner periphery of the outlet 442 or the outer periphery of the fourth linking part 475. Functions of the washer are to increase marginal adaptability between the bendable portions 463 and the fourth linking part 475 as well as reduce the friction effect.

The bendable portion 463 is formed with a metal or an alloy with the properties of ductility and malleability, and fixed on the fourth linking part 475 via use of metal riveting or welding. The bendable portion 463 can move axially relative to the outlet 442, and possesses ductility resulting in shapes and sizes of the loop-shaped fork being adjusted and fixed. For example, to adjust different curvatures, the bendable portion 463 can change the size of the loop-shaped ornament. The bendable portion 463 is made of a ductile metal or alloy, noble metals using for ornaments or dining utensils, such as gold, silver, platinum, tin, titanium and stainless steel. One original property of metal is having a plastic deformation ability at room temperature, and it can be cold worked. The selected metal specimens must be no cracks or delamination occurs during cold bending test. One tensile strength$\sigma b$ of the selected metal of the bendable portion is between 40 MPa and 1000 MPa; elongation $\delta$ is greater than 7%. The bendable portion 463 can be bent into a desired shape and can be recovered with a reverse force by hands. A desired shape can be done when the bending force is between 0.5 and 10 kgf. A cross-section area can be obtained from mechanical prosperities testing results of the selected metal, and thus the requirement of the 0.5 to 10 kgf bending force can be achieved. As can be seen from FIG. 6, the rigid function portion 401, the holder 403 and the shapeable connectors 418 of the present invention are each independent. Therefore, if necessary, each of the parts can be replaced and various types of the rigid function portion 401 or the holder 403 can be selected.

Figure 7:
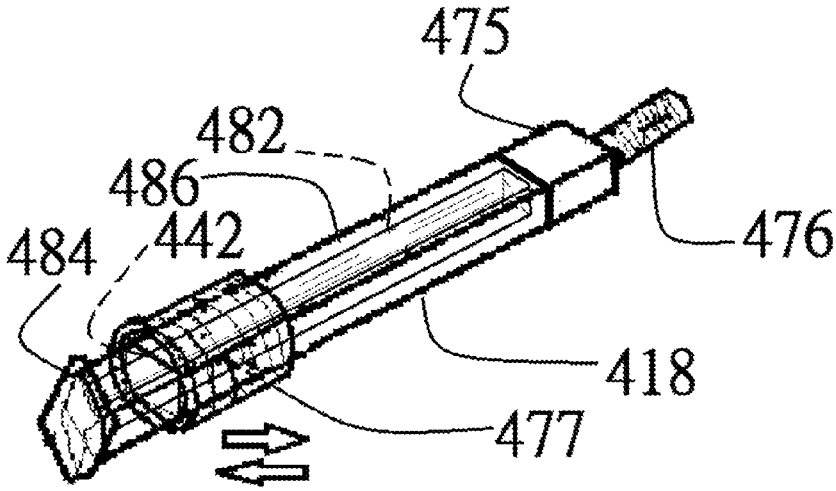
FIG. 7 is a perspective view of the fifth linking part and the shapeable connector.

FIG. 7 is a perspective view of the fifth linking part and the shapeable connector. As shown in FIG. 7, the shapeable connector 418 includes a bendable portion 486 whose function is the same as the bendable portion 463. A body of the bendable portion 486 can be ellipse or square with serrated and can be easily adjusted to a desired shape. The bendable portion 486 is covered with a soft silicone, rubber, polyethylene or polypropylene sleeve 482 for increasing marginal adaptability with the outlet 442 of the fifth linking part 477 as well as for reducing the friction effect. The bendable portion 486 can also be formed with the commonly used copper or aluminum alloy. The bendable portion 486 is similar to a commonly used electrical copper wire with 1.6 or 2.0 mm diameter and covered with a soft polymer rust proof layer or insulating layer. The sleeve 482 made of silicone does not cause skin allergies and uncomfortable. A stopper 484 is formed at one end of the bendable portion 486 to prevent the bendable portion 486 from separating off the fifth linking part 477. As can be seen from FIG. 7, the bendable portion 486 with the silicone sleeve 482 can move axially relative to the outlet 442, and as the same function of the bendable portion 463 and the outlet 442.

Embodiment 2

Figure 8:
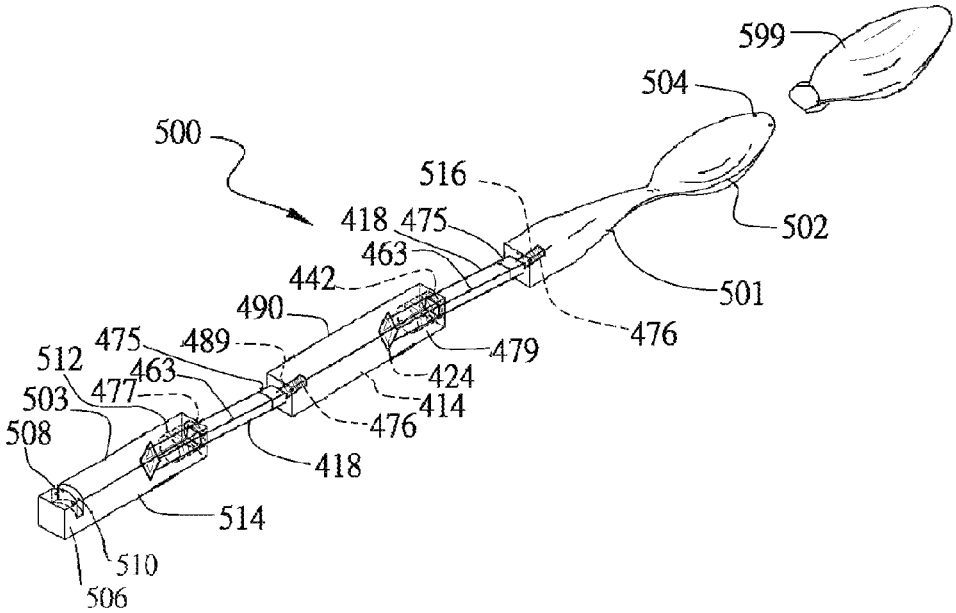
FIG. 8 is an exploded perspective view of a wearable spoon.
Figure 9:
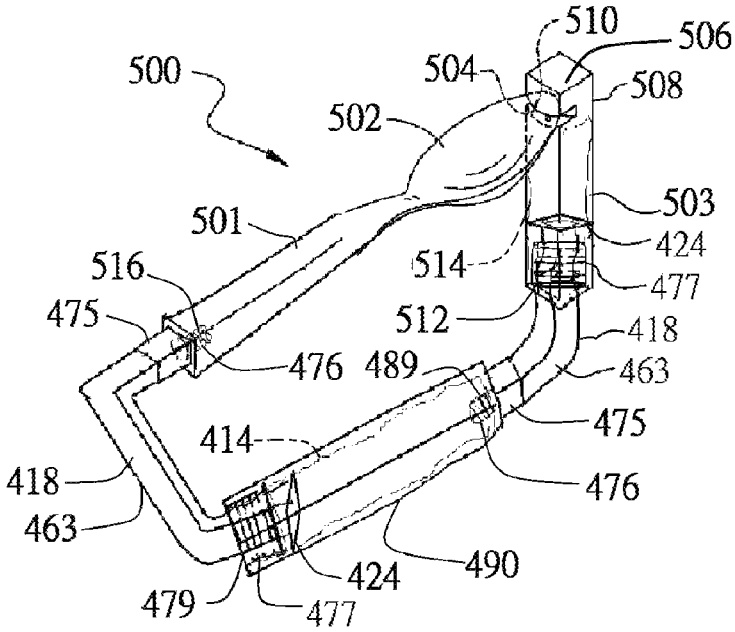
FIG. 9 is a perspective view of the spoon of FIG. 8 forming a loop.
Figure 10:
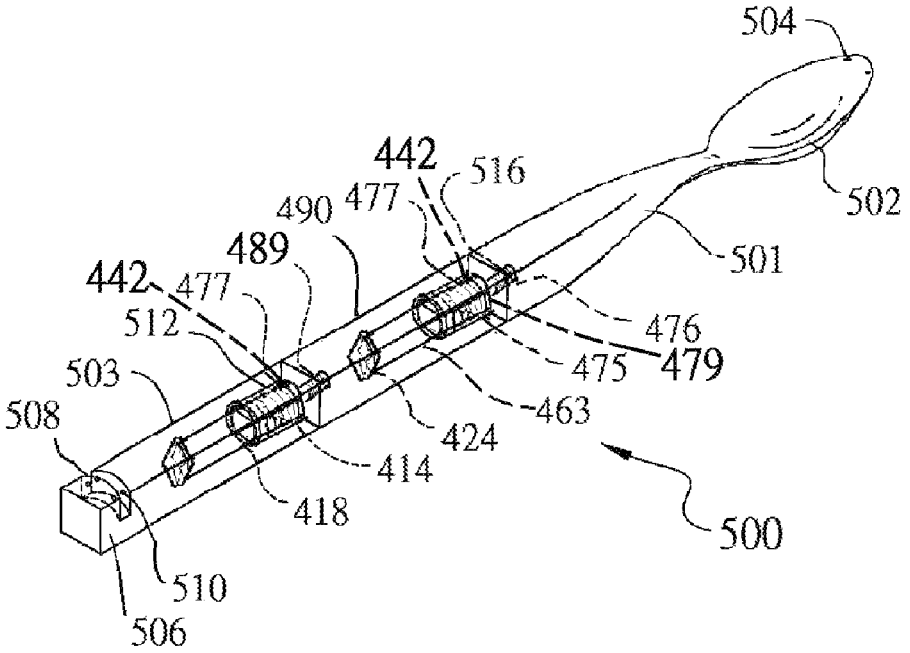
FIG. 10 is a perspective view of the spoon of FIG. 8 forming a normal used spoon.

FIGS. 8-10 show aspects of a wearable spoon in the embodiment 2 of the present invention.

FIG. 8 is an exploded perspective view of a wearable spoon. As shown in FIG. 8, a spoon 500 includes a rigid function portion 501, a holder 503, a rigid central portion 490 and two shapeable connectors 418. The rigid function portion 501 in the embodiment 2 has a spoon terminating at one end in an arc tip, which is intended to ladle portions of food, and the arc tip also serves as a male linker 502. The opposite end of the rigid function portion 501 has a first linking part 516 which is of a round cross-section. The holder 503 is intended to hold the spoon 500. One end of the holder 503 serves as a female linker 506 used for linking with the male linker 502, and the opposite end has a second linking part 512 extending a hollow to a middle part 514 of the holder 503. The shapeable connectors 418 intended to connect the rigid function portion 501, the rigid central portion 490 and the holder 503 have a third linking part 476 used for linking with the first linking part 516. A fifth linking part 477 is used for linking with the second linking part 512. Structures and functions of the shapeable connectors 418 as well as the fifth linking part 477 are described in embodiment 1. The outlet 442 is used for linking with the fourth linking part 475 and can get the bendable portion 463 moving through the middle part 514 of the holder 503 when the fifth linking part 477, the shapeable connector 418 and the second linking part 512 are linked. A transparent silicone sheath 599 with a thickness of 0.02 to 0.5 mm forming a protective cover upon the rigid function portion 501 is added. The protective cover 599 is a replaceable consumable.

A cavity 508 for engaging with the male linker 502 is formed in the female linker 506 of the holder 503. Dents 504 for locking with knots 510 which are formed on each middle site of sidewalls of the cavity 508 are formed on the tip of the male linker 502. A shape of the cavity 508 is adopted to fit the male linker 502 resulting in matched coupling formed by the cavity 508 and the male linker 502. A cavity can be formed in the bottom side of female linker 506, and the cavity can be a shape of cavity that the concave side of spoon face outwardly when the male linker 502 is engaged with the cavity. One rigid central portion 490 can be added between the rigid function portion 501 and the holder 503 of the spoon 500. Structures and functions of the rigid central portion 190 are described in embodiment 1. It is understood that the rigid central portion 490 is used to increase a length of the spoon 500. The spoon 500 forms a loop with a desired size and shape when the male linker 502 is engaged with the female linker 506 of the holder 503, as shown in FIG. 9. Additionally, the shape and size of the loop-shaped spoon 500 can be adjusted and fixed through the bendable portions 463. The spoon 500 forms a normal used spoon which has the two shapeable connectors 418 received in the inner of the spoon 500 when each the fourth linking part 475 is engaged with each the outlet 442, as shown in FIG. 10.

Embodiment 3

FIGS. 11-14 show aspects of a wearable chopstick in the embodiment 3 of the present invention.

Figure 11:
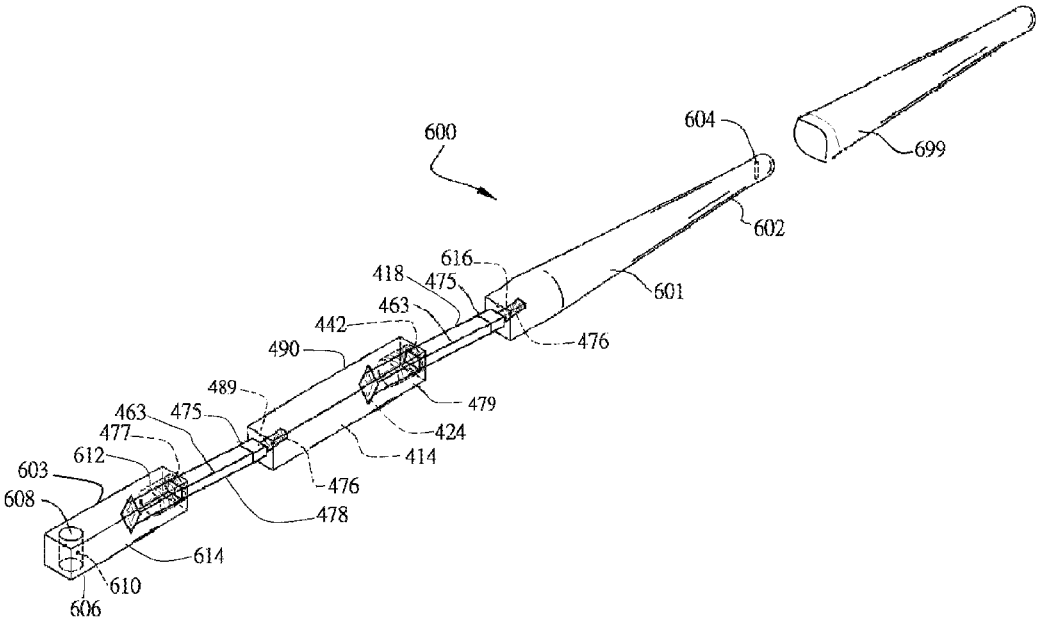
FIG. 11 is an exploded perspective view of a wearable chopstick.

FIG. 11 is an exploded perspective view of a wearable chopstick. As shown in FIG. 11, a chopstick 600 includes a rigid function portion 601, a holder 603, a rigid central portion 490 and two shapeable connectors 418. The rigid function portion 601 in the embodiment 3 has a chopstick terminating at one end in a rounded tip which is intended to engage portions of food and the rounded tip also serves as a male linker 602. The opposite end of the rigid function portion 601 has a first linking part 616 which is of a round cross-section. The holder 603 is intended to hold the chopstick 600. One end of the holder 603 serves as a female linker 606 used for linking with the male linker 602, and the opposite end has a second linking part 612 extending a hollow to a middle part 614 of the holder 603. The shapeable connectors 418 intended to connect the rigid function portion 601, the rigid central portion 490 and the holder 603 have a third linking part 476 used for linking with the first linking part 616. A fifth linking part 477 is used for linking with the second linking part 612. Structures and functions of the shapeable connectors 418 as well as the fifth linking part 477 are described in embodiment 1. The outlet 442 is used for linking with the fourth linking part 475 and can get the bendable portion 463 moving through the middle part 614 of the holder 603 when the fifth linking part 477, the shapeable connector 418 and the second linking part 612 are linked. A transparent silicone sheath 699 with a thickness of 0.02 to 0.5 mm forming a protective cover upon the rigid function portion 601 is added. The protective cover 699 is a replaceable consumable.

Figure 12:
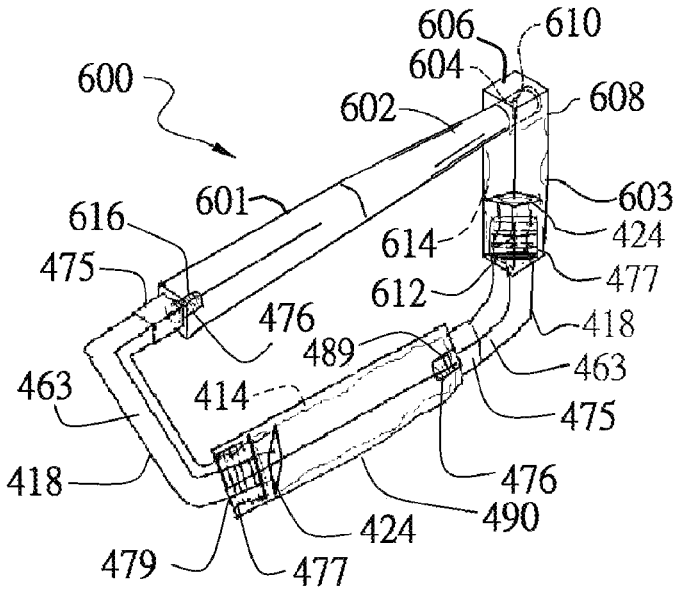
FIG. 12 is a perspective view of the chopstick of FIG. 11 forming a loop.
Figure 13:
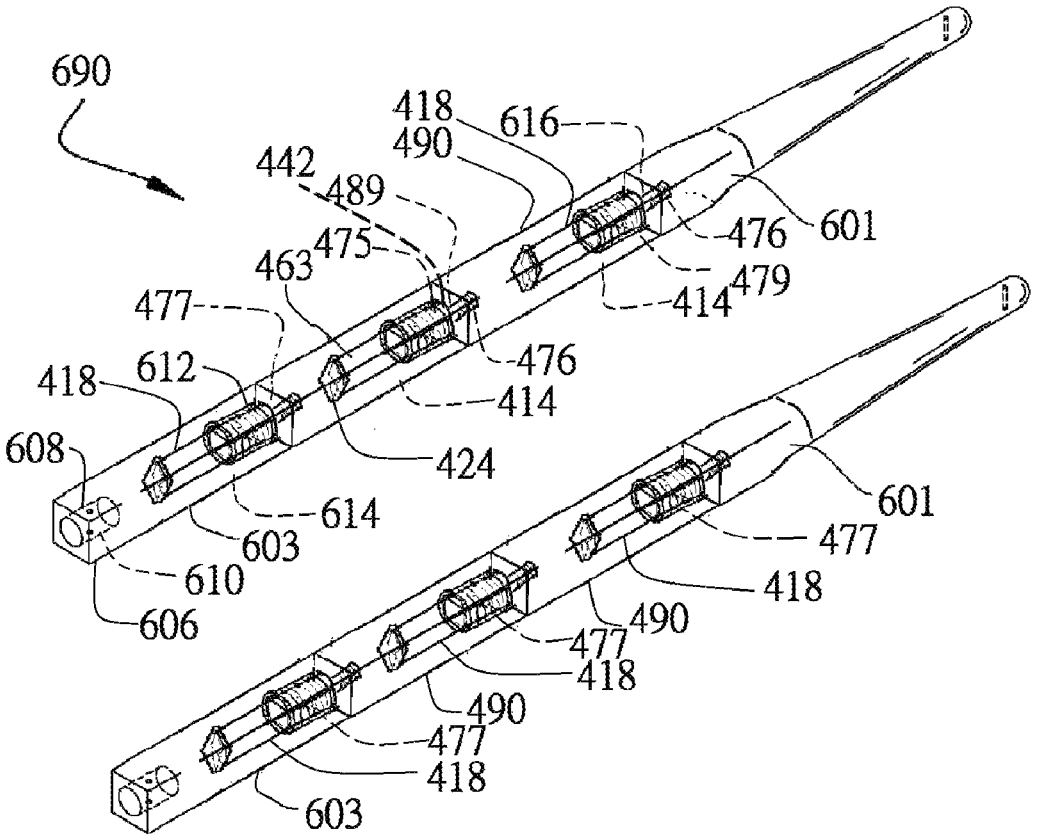
FIG. 13 is a perspective view of a pair of normal use chopsticks from which two rigid central portions are added to the chopstick of FIG. 11.

A cavity 608 for engaging with the male linker 602 is formed in the female linker 606 of the holder 603. Dents 604 for locking with knots 610 which are formed on each middle site of sidewalls of the cavity 608 are formed on the tip of the male linker 602. A shape of the cavity 608 is adopted to fit the male linker 602 resulting in matched coupling formed by the cavity 608 and the male linker 602. A cavity can be formed in the bottom side of female linker 606 and can be four sides closed cavities. One rigid central portion 490 can be added between the rigid function portion 601 and the holder 603 of the chopstick 600. Structures and functions of the rigid central portion 490 are described in embodiment 1. It is understood that the rigid central portion 490 is used to increase a length of the chopstick 600. The chopstick 600 forms a loop with a desired size and shape when the male linker 602 is engaged with the female linker 606 of the holder 603, as shown in FIG. 12. Additionally, the shape and size of the loop-shaped chopstick 600 can be adjusted and fixed through the bendable portions 463. FIG. 13 is a perspective view of a pair of normal use chopsticks 690 from which two rigid central portions 490 are added between the rigid function portion 601 and the holder 603 of each the chopstick 600 in FIG. 11. The pair of chopsticks 690 forms normal use chopsticks which have the shapeable connectors 418 received in the inner of the chopsticks 690 when each the fourth linking part 475 is engaged with each the outlet 442, as shown in FIG. 13.

Figure 14:
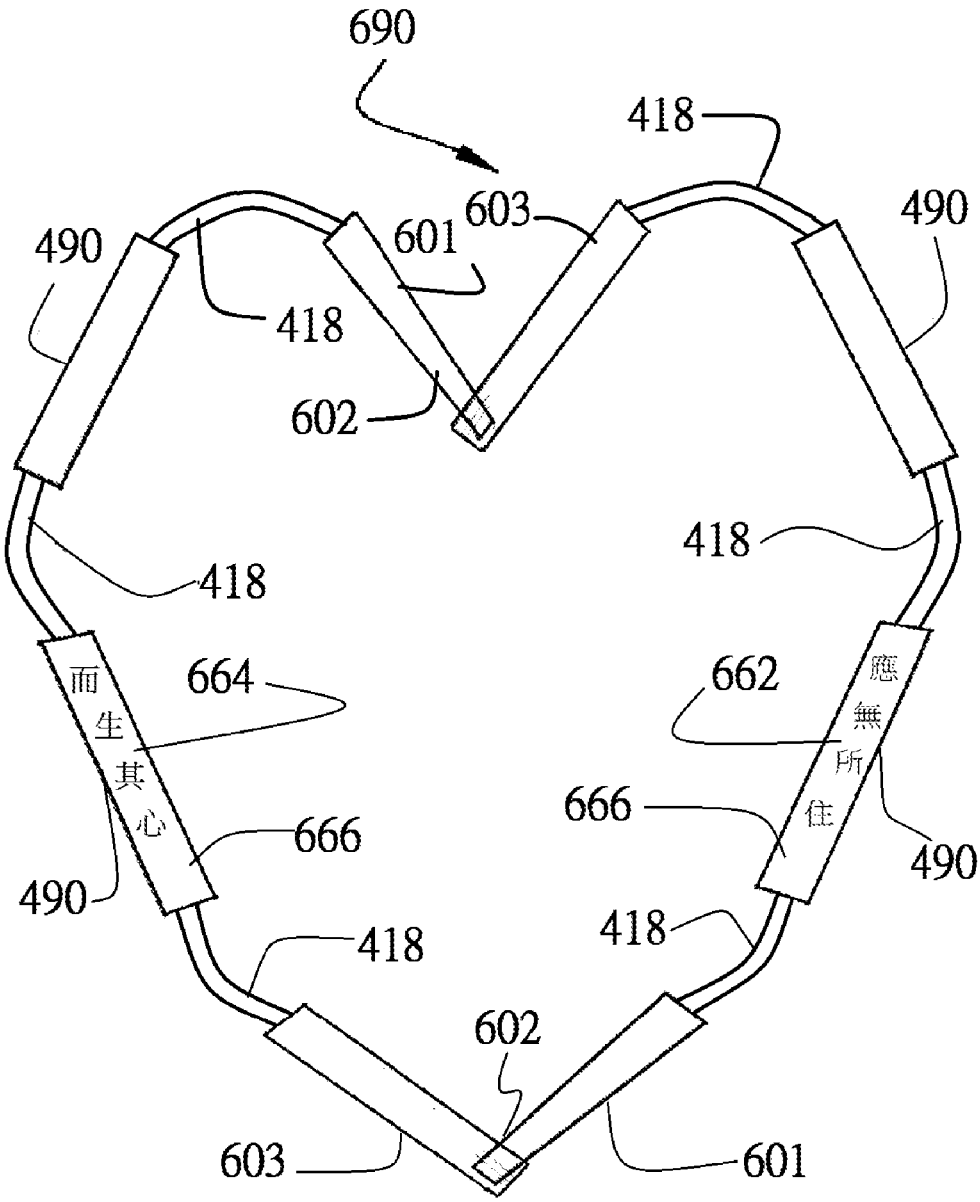
FIG. 14 is a top plan view of the pair of chopsticks heart-shaped from which two rigid central portions are added.

FIG. 14 is a top plan view of the pair of chopsticks 690 heart-shaped from which two rigid central portions 490 are added between the rigid function portion 601 and the holder 603 of each the chopstick 600 in FIG. 11, wherein two chopsticks are mutually engaged through heads and tails forming a heart. As can be seen from FIG. 14, the shape and size of the heart-shaped chopsticks 690 can be adjusted and fixed through each the shapeable connectors 418 and the bendable portions 463. A surface 666 of the central portions 490 can be laser engraved text or pattern, as can be seen upon 662 and 664. The present invention gives dining utensils another concept and motivates people to carry utensils. "Personal and Exclusive Utensil" is a goal for further development. The dining utensils are not only tools for dinning but also interesting elements when dinning.

Compared to U.S. Pat. No. 8,176,751, the present invention has several advantages. First, the embodiments enable dining utensils to be wearable by using simple structure and easy assembly to form a bracelet, necklace, belt or an ornament of handbag or hand-held mobile device. The shape and size of the wearable dining utensil with a shapeable connector can be adjusted and fixed when forming a loop-shaped ornament. Second, aimed at a goal of "Personal and Exclusive Utensil", favorite material, color, pattern or style of one dining utensil can be chosen and can even be engraved with a pattern and text, in accordance with various tastes for each person. Additionally, antibacterial plastic, ceramics, stainless steel or other metals can be employed to produce dining utensils, and thus the cleanness and sanitation of the wearable dining utensil can be maintained. Finally, each required component of the present invention is independent, shareable and replaceable to accomplish the environmental protection.

What is claimed is:

1. A wearable dining utensil, comprising:

a rigid function portion with a tip terminating at one end for engaging food, wherein the tip also serves as a male linker, and an opposite end of the rigid function portion has a first linking part;

a holder with one end serving as a female linker and an opposite end having a second linking part, wherein the female linker is used for linking with the male linker and the second linking part comprises a hollow portion extending to a middle part of the holder;

a shapeable connector with a third linking part and a fourth linking part extending from the third linking part, wherein the third linking part is used for linking with the first linking part and the fourth linking part is used for fixing a bendable portion, wherein the bendable portion can be bent into a desired shape and can be recovered with a reverse force; and a fifth linking part, for linking with the second linking part, a central part of the fifth linking part having an outlet whose shape is adopted to fit the bendable portion there through, wherein in a retracted position of the bendable portion in which the bendable portion is received into the middle part of the holder, the outlet is used for linking with the fourth linking part such that the fifth linking part, the shapeable connector and the second linking part are linked and the rigid function portion and holder abut, and in an extended position of the bendable portion the fourth linking part and the fifth linking part are disengaged such that the rigid function portion and holder are separated, wherein the dining utensil forms a loop with a desired size and shape when the male linker is engaged with the female linker as well as the dining utensil forms a normal used dining utensil which has the shapeable connector received inside the dining utensil when the fourth linking part is engaged with the outlet.

2. The wearable dining utensil as recited in claim 1, wherein the dining utensil is a chopstick, a spoon or a fork.

3. The wearable dining utensil as recited in claim 1, wherein the bendable portion is formed with a metal or an alloy with the properties of ductility and malleability, and fixed on the fourth linking part via use of metal riveting or welding.

4. The wearable dining utensil as recited in claim 1, wherein the bendable portion is covered with a soft silicone, rubber, polyethylene or polypropylene sleeve for increasing marginal adaptability with the outlet of the fifth linking part as well as reducing the friction effect.

5. The wearable dining utensil as recited in claim 1, wherein the dining utensil forms a bracelet, necklace, belt or an ornament of handbag or hand-held mobile device through various connecting profiles.

6. The wearable dining utensil as recited in claim 1, wherein a connection manner of the third linking part with the first linking part as well as the fifth linking part with the second linking part is a connection of male and female thread.

7. The wearable dining utensil as recited in claim 1, wherein the female linker has a cavity whose shape is adopted to fit the male linker resulting in matched coupling, and the tip of the male linker has dents for locking with knots formed on each middle site of sidewalls of the cavity.

8. The wearable dining utensil as recited in claim 1, wherein a cross-section shape of the fourth linking part and of the outlet is a circle, ellipse, square or rectangle, and an external diameter of the fourth linking part is about equal to an internal diameter of the outlet causing a tight connection.

9. The wearable dining utensil as recited in claim 1, further comprising a transparent silicone sheath with a thickness of 0.02 to 0.5 mm forming a protective cover upon the rigid function portion.

10. A wearable dining utensil, comprising:

a rigid function portion with a tip terminating at one end for engaging food, wherein the tip also serves as a male linker, and an opposite end of the rigid function portion has a first linking part;

a holder with one end serving as a female linker and an opposite end having a second linking part, wherein the female linker is configured to link with the male linker, and the second linking part comprises a hollow portion;

at least one rigid central portion disposed between the rigid function portion and the holder, each rigid central portion comprising a first linking part corresponding to that of the rigid function portion at one end, and a second linking part comprising a hollow portion corresponding to the second linking part of the holder at the opposite end;

a plurality of shapeable connectors, wherein each shapeable connector comprises a third linking part configured to link with the first linking part of the rigid function portion or the holder, a fourth linking part, and a bendable portion, wherein the bendable portion can be bent into a desired shape and can be recovered with a reverse force; and a plurality of fifth linking parts, each respectively linked to the second linking part of a corresponding rigid central portion or holder, each fifth linking part having an outlet;

wherein the rigid function portion, the at least one rigid central portion, and the holder are linked in sequence by the shapeable connectors, with the third linking part of each shapeable connector linked with the first linking part of a corresponding rigid function portion or rigid central portion, and the bendable portion received into the hollow portion of a corresponding second linking part of a corresponding rigid central portion or holder via the outlet of the corresponding fifth linking part;

arranged such that in a retracted position of the bendable portion, the bendable portion is received into the middle part of the corresponding rigid central portion or holder, and the outlet of the corresponding fifth linking portion is linked to the fourth linking part of the corresponding shapeable connector such that the rigid function portion, the at least one rigid central portion, and the holder respectively abut, so as to form a normal-use dining utensil which has the shapeable connectors received inside the holder and at least one rigid central portion, and in an extended position of the bendable portion the fourth linking part of the corresponding shapeable connector and the corresponding fifth linking part are disengaged, such that the rigid function portion, the at least one rigid central portion, and the holder are spaced apart by the bendable portions and the dining utensil can be formed into a loop by engaging the male linker with the female linker.

11. The wearable dining utensil as recited in claim 10, wherein the dining utensil is a chopstick, a spoon or a fork.

12. The wearable dining utensil as recited in claim 10, wherein the bendable portion is formed with a metal or an alloy with the properties of ductility and malleability, and fixed on the fourth linking part via use of metal riveting or welding.

13. The wearable dining utensil as recited in claim 10, wherein the bendable portion is covered with a soft silicone, rubber, polyethylene or polypropylene sleeve for increasing marginal adaptability with the outlet of the fifth linking part as well as reducing the friction effect.

14. The wearable dining utensil as recited in claim 10, wherein the dining utensil forms a bracelet, necklace, belt or an ornament of handbag or hand-held mobile device through various connecting profiles.

15. The wearable dining utensil as recited in claim 10, wherein a connection manner of the third linking part with the first linking part as well as the fifth linking part with the second linking part is a connection of male and female thread.

16. The wearable dining utensil as recited in claim 10, wherein the female linker has a cavity whose shape is adopted to fit the male linker resulting in matched coupling, and the tip of the male linker has dents for locking with knots formed on each middle site of sidewalls of the cavity.

17. The wearable dining utensil as recited in claim 10, wherein a cross-section shape of the fourth linking part and of the outlet is a circle, ellipse, square or rectangle, and an external diameter of the fourth linking part is about equal to an internal diameter of the outlet causing a tight connection.

18. The wearable dining utensil as recited in claim 10, further comprising a transparent silicone sheath with a thickness of 0.02 to 0.5 mm forming a protective cover upon the rigid function portion.

* * * * *